US007139224B2

(12) United States Patent
Schneider

(10) Patent No.: US 7,139,224 B2
(45) Date of Patent: Nov. 21, 2006

(54) CALENDAR STEPPING MECHANISM

(75) Inventor: Jens Schneider, Glashütte-Johnsbach (DE)

(73) Assignee: Lange Uhren GmbH, Glashuette (DE)

( * ) Notice: Subject to any disclaimer, the term of this patent is extended or adjusted under 35 U.S.C. 154(b) by 0 days.

(21) Appl. No.: 11/387,298

(22) Filed: Mar. 23, 2006

(65) Prior Publication Data

US 2006/0215497 A1 Sep. 28, 2006

(30) Foreign Application Priority Data

Mar. 24, 2005 (DE) ..... 10 2005 014 328

(51) Int. Cl.
*G04B 19/20* (2006.01)
*G04B 19/24* (2006.01)

(52) U.S. Cl. ..... 368/28; 368/37

(58) Field of Classification Search ..... 368/28, 368/35–38

See application file for complete search history.

(56) References Cited

U.S. PATENT DOCUMENTS

| | | | | |
|---|---|---|---|---|
| 4,674,889 | A * | 6/1987 | Klaus | 368/28 |
| 5,432,759 | A * | 7/1995 | Vaucher | 368/28 |
| 6,744,696 | B1 * | 6/2004 | Vernay et al. | 368/37 |
| 6,912,180 | B1 * | 6/2005 | Dias | 368/37 |
| 7,027,360 | B1 * | 4/2006 | Kitahara et al. | 368/28 |

FOREIGN PATENT DOCUMENTS

| | | |
|---|---|---|
| DE | 202 08 525 U1 | 11/2003 |

* cited by examiner

*Primary Examiner*—Vit W. Miska
(74) *Attorney, Agent, or Firm*—Cohen, Pontani, Lieberman & Pavane

(57) ABSTRACT

A calendar stepping mechanism of an eternal calendar of a clock includes a month disk with indentations and elevations corresponding to forty-eight months of a leap year period and a calendar wheel having 31 teeth with one stepping tooth and normal teeth for driving a calendar date display. A stepping lever is pivoted once a day and has a probe finger that rests on the month disk in a normal position of the stepping lever. A connecting link arranged such that, during the pivoting movement of said stepping lever from its normal position into its raised position, a stepping pawl slides along the connecting link, wherein during a first part of the pivoting movement of said stepping lever, the connecting link supports the pawl tooth at a radial distance from an axis of said calendar wheel between the tip circle of the normal teeth and the tip circle of said stepping tooth and, during the second part of the pivoting movement of the shifting lever, the connecting link supports the pawl tooth at a radial distance inward of the tip circle of the normal teeth, wherein a transition from the first part to the second part of the pivoting movement of the stepping lever occurs at the point which the pawl tooth occupies when the stepping lever is in its normal position and the probe finger is in contact with one of the elevations of the stepped month disk.

6 Claims, 5 Drawing Sheets

CALENDAR STEPPING MECHANISM

BACKGROUND OF THE INVENTION

The invention pertains to a calendar stepping mechanism of an eternal calendar of a clock, the stepping mechanism having a stepping lever driven once per twenty-four hours around a pivot axis between a normal position and a raised position, a probe finger on the stepping lever, which can be moved radially from the outside against the circumferential periphery of a stepped month disk, the periphery being provided with twenty indentations of different depths and twenty elevations, which represent the forty-eight months of a leap year period, where the stepped month disk can be driven to rotate at a rate of one step per month and one revolution per four years, a rotatably supported calendar wheel having thirty-one teeth or a multiple thereof, where a stepping tooth, projecting beyond the other normal teeth, is provided for each set of thirty-one teeth, wherein the calendar wheel can be advanced by a pawl tooth of a stepping pawl, which is hinged to the stepping lever and can engage radially in the gaps between the teeth of the calendar wheel under the pivoting movement of the stepping lever, this movement depending on the contact position of the probe finger on the periphery of the stepped month disk, and wherein the clock's display of the calendar date can be driven by the calendar wheel.

Eternal calendars are mechanisms which allow a clockwork to step the calendar display forward in such a way that, on the correct day at the end of each month, the calendar display is set automatically to the first day of the new month under consideration of whether the year in question is a leap year or not. The information on the correct length of the various months is stored in a stepped month disk with indentations of different depths, which advances one step each month and completes one revolution every four years. This stepped month disk causes a stepping lever to perform a stroke corresponding to the length of the month in question, as a result of which, at the end of the month, it is possible all at once to step through the appropriate number of additional days required to display the first day of the new month. It is therefore necessary for the stepping lever both to advance the wheel one day forward every day and to advance the wheel one or more days forward at the end of the month to reach the point at which the new month begins.

In a calendar stepping mechanism of the type described above, it is known that the stepping lever has two shifting elements, one of which engages in the calendar wheel to step the date forward by one day. The calendar wheel carries a worm-like disk, which is oriented in such a way that, depending on the stroke determined by the stepped month disk, the second shifting element of the stepping lever engages in the step of the worm at the end of the month and advances the calendar wheel to the first day of the new month.

Because of the presence of two shifting elements, it is necessary to adjust their position with respect to the calendar wheel and with respect to each other with great precision to ensure the correct engagement at the correct moment. For the stepping operation at the end of the month, one shifting element must take over the stepping function from the other shifting element, which leads to jerks and changes in rotational speed and which must also be adjusted with great precision.

SUMMARY OF THE INVENTION

An object of the present invention is to provide a calendar stepping mechanism which overcomes all the problems associated with the prior art by providing a simple design which guarantees trouble-free calendar shifting.

The object of the present invention is achieved by a calendar stepping mechanism having a connecting link arranged such that, during the pivoting movement of a stepping lever from a normal position into a raised position, a stepping pawl slides along the connecting link. During a first part of the pivoting movement of said stepping lever, a pawl tooth moves radially inward into an area between the tip circle of normal teeth of the calendar wheel and the tip circle of a stepping tooth of the calendar wheel. During the second part of the pivoting movement of the shifting lever, the pawl tooth moves radially inward beyond the tip circle of the normal teeth. A transition from the first part to the second part of the pivoting movement of the stepping lever occurs at the point which the pawl tooth of the stepping pawl occupies when the stepping lever is in its normal position and the probe finger is in contact with an elevation of the stepped month disk.

As a result of this design, only a single stepping pawl is needed to step the calendar wheel forward, and the connecting link ensures that the stepping pawl engages either only with the normal teeth or only with the stepping tooth when that tooth is in a defined position.

An easy-to-build design includes a stationary stop cam along the outside circumferential periphery of the calendar wheel. During the pivoting movement of the stepping lever, the pawl tooth slides along this cam. The first part of the stop cam is concentric to the axis of rotation of the calendar wheel and projects beyond the tip circle of the normal teeth but is still radially inside the tip circle of the one stepping tooth. The second part is also concentric to the axis of rotation of the calendar wheel but is also radially inside the tip circle of the normal teeth of the calendar wheel. The transition from the first part to the second part of the stop cam is at the point which the pawl tooth occupies when the stepping lever is in its normal position and the probe finger is in contact with an elevation of the stepped month wheel.

So that the stepping pawl will engage reliably in the gaps between the teeth of the calendar wheel, the stepping pawl may be spring-loaded in the direction toward the tooth gaps of the calendar wheel.

So that the stepping lever can return from its raised position to its normal position again, the stepping lever is preferably spring-loaded toward this normal position.

The number of components can be reduced and space can be saved by using a common spring to actuate both the stepping lever and the stepping pawl.

For this purpose, the stepping pawl can be designed as a two-arm lever, which is hinged pivotably to the stepping lever so that it can pivot around an axis parallel to the axis of rotation of the calendar wheel. The pawl tooth is mounted on one of the arms of this lever, and a spring acts on the other arm.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
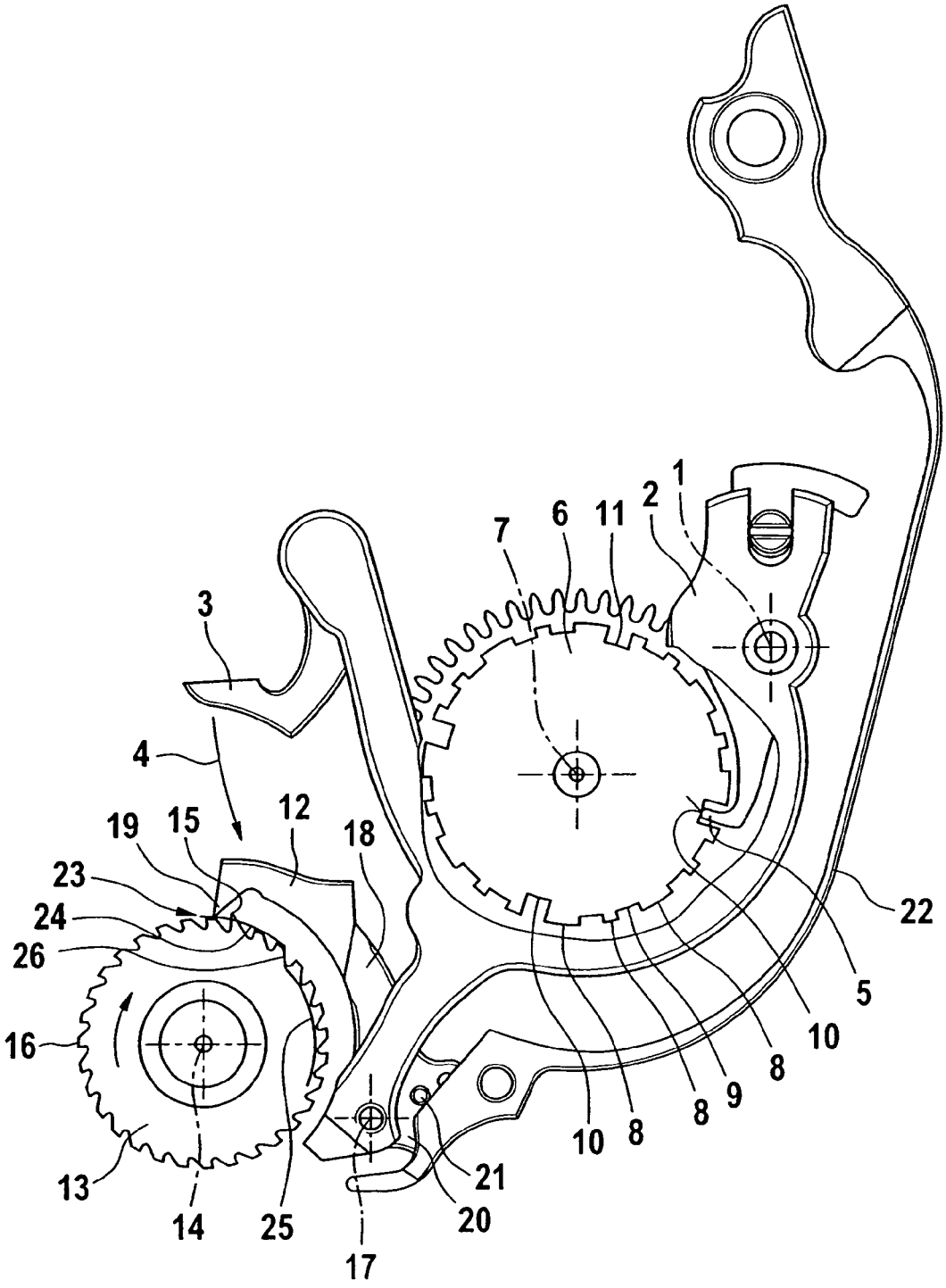
FIG. 1 is a partial cutaway view of a calendar stepping mechanism of a clock before a stepping operation in the position corresponding to February 28 of a normal year.

The calendar stepping mechanism shown in the FIGS. 1–5 has a pivotably driven stepping lever 2, which can be pivoted once per 24 hours around a pivot axis 1 between a normal position (FIGS. 1–4) and the raised position (FIG. 5), for which purpose a lever extension 3 of the stepping lever 2 is actuated as indicated by the arrow 4.

A probe finger 5 is permanently connected to the stepping lever 2. The pivoting movement of the stepping lever 2 from the normal position to the raised position causes this finger to move radially away from contact with the circumferential periphery of a stepped month disk 6.

The stepped month disk 6 has, on its circumferential periphery, twenty indentations 9, 10, and 11 of different depths and twenty elevations 8, which represent the forty-eight months of a leap year period. During the periodic pivoting of the stepping lever 2, the extent of the pivoting movement of the stepping lever 2 toward the axis of rotation 7 of the stepped month disk 6 is dependent on which of the indentations 9, 10, 11 or elevations 8 that the probe finger 5 is aligned with.

The elevations 8 represent months with 31 days, the indentations 9 of least depth months with 30 days, the indentation 10 of greatest depth a February with 28 days, and the indentation 11 the February of a leap year.

A stepping pawl 12 mounted on the stepping lever 2 engages a calendar wheel 13. The stepping pawl 12 mounted on the stepping lever 2 moves with the stepping lever 2 during the daily pivoting movement and rotates the calendar wheel 13 clockwise around an axis of rotation 14.

The calendar wheel 13 has thirty-one sawtooth-shaped teeth. The stepping pawl 12 has a pawl tooth 19 which engages in the gaps between the teeth of the calendar wheel 13. The thirty-one teeth of the calendar wheel 13 include a stepping tooth 15 and thirty normal teeth 16. The stepping tooth 15 has a tip circle which projects radially beyond the tip circle of the thirty normal teeth 16. The tip circle of the stepping tooth 15 is a circle having a radius equal to the radial distance of the tip of the stepping tooth from the axis 14. Likewise, the tip circle of the normal teeth 16 is a circle having a radius equal to the radial distance of the tips of the normal teeth from the axis 14. The calendar wheel 13 drives the calendar display of a clock (not shown) by a set of gear wheels (not shown).

The stepping pawl 12 is designed as a two-arm lever, which is hinged pivotably to the stepping lever 2 so that it can pivot about an axis 17 parallel to the axis of rotation 14 of the calendar wheel 13. The pawl tooth 19 which engages in the tooth gaps of the calendar wheel 13, is mounted on an arm 18, i.e., one of the arms of the two-arm lever of the stepping pawl 12.

The other lever arm 20 of the stepping pawl 12 has a pin 21, which extends parallel to the axis 17. This pin 21 is actuated by the free end of a pretensioned spring arm 22. The other end of spring arm 22 is fixed permanently in place.

Because the radial distance of the pin 21 to the pivot axis 1 of the stepping lever 2 is smaller than the radial distance between the pivoting axis 17 of arm 18 to the pivot axis 1, the spring arm 22 keeps both the stepping lever 2 spring-loaded in its normal position and the pawl tooth 19 of the stepping pawl 12 in spring-loaded contact with the calendar wheel 13.

Along the outer circumferential periphery of the calendar wheel 13, a stationary stop cam 23 is provided next to the calendar wheel 13. The cam 23 includes a first part 24, concentric to the axis of rotation 14, and a second part 25, also concentric to the axis of rotation 14. The first concentric part 24 extends concentrically at a radial distance between the tip circle of the normal teeth 16 and the tip circle of the stepping tooth 15, whereas the second concentric part 25 has a shorter radius with respect to the axis of rotation 14 than the tip circle of the normal teeth 16.

The pawl tooth 19 rests on the stop cam 23 and slides along the stop cam 23 when the stepping lever 2 pivots.

The transition 26 from the first part 24 to the second part 25 of the stop cam 23 is located at the point which the pawl tooth 19 occupies when the stepping lever 2 is in its normal position and the probe finger 5 is in contact with an elevation 8 of the stepped month wheel 6.

When the month changes, the proper calendar display is produced by the outward deflection of the stepping lever 2 and the probe finger 5 in such a way that the probe finger 5 is outside the stepped month disk 6. This allows the stepped month disk 6 to be advanced one step farther by the 31-tooth calendar wheel 13, which acts by way of an additional mechanism (not shown). As a result, the section of the stepped month disk 6 corresponding to the length of the current month is always resting against the probe finger 5. The spring arm 22 presses against the stepping lever 2, which is permanently connected to the probe finger 5 and which moves in common with it around the common pivot axis 1. The spring arm 22 thus has the effect of urging the probe finger 5 into the normal position against the stepped month disk 6.

FIG. 1 shows the calendar stepping mechanism in the position which is present during a month with 28 days (February). The probe finger 5 is located in a deep indentation 10 in the stepped month disk 6, so that the stroke of the probe finger 5 and of the stepping lever 2 is so long that the pawl tooth 19 travels over four teeth of the calendar wheel 13. When the stepping tooth 15 is located outside of the circumferential area of the first concentric part 24 of the stop cam 23 (as shown, for example, in FIG. 5), the calendar wheel 13 can be stepped forward by only one tooth because the pawl tooth 19 rests on the stop cam 23, which covers the first three normal teeth 16. As a result, the stepping pawl 12 cannot engage in the calendar wheel 13 until the pawl tooth 19 reaches the transition to the second part 25 of the stop cam 23. The transition point 26, however, is located so that the calendar wheel 13 can be advanced only by one tooth (corresponding to one day). The stepping lever 2 is prevented from moving past the end position shown in FIG. 5 by contact of the spring arm 22 with a permanently installed stop 27.

FIG. 1 shows the position of the calendar stepping mechanism on the 28th of February. On this day, the stepping tooth 15 of the calendar wheel 13 is in a position in which it can be gripped by the pawl tooth 19 of the stepping pawl 12. This is possible, because the stepping tooth 15 projects radially beyond the contour of the first concentric part 24 of the stop cam 23. Thus the stepping pawl 12 of the stepping lever 2 will engage the stepping tooth 15 of the calendar wheel 13 at the end of the 28th of February and move it forward four steps, which is equivalent to shifting the calendar far enough forward to display the first day of the new month.

Figure 2:
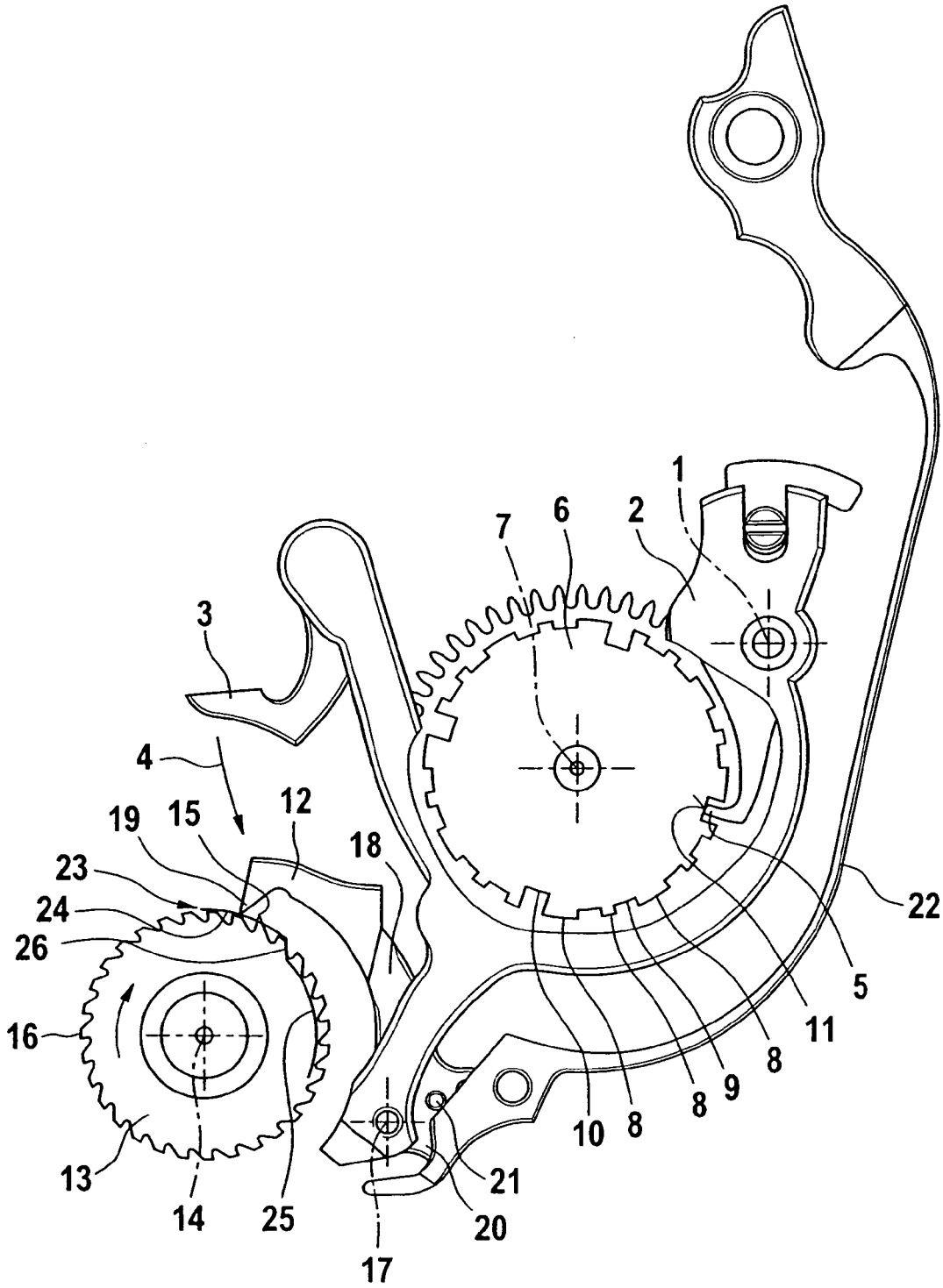
FIG. 2 is a partial cutaway view of the calendar stepping mechanism according to FIG. 1 before a stepping operation in the position corresponding to February 29 of a leap year.

FIG. 2 shows the position of the calendar stepping mechanism on the 29th of February of a leap year. Here the indentation 11 in the stepped month disk 6 is shallower, which means that the stroke of the stepping lever 2 is limited by the contact of the probe finger 5 to such an extent that the pawl tooth 19 of the stepping pawl 12 travels over only three teeth of the calendar wheel 13 before dropping behind the stepping tooth 15, when the position of the calendar wheel 13 corresponds to the calendar display 29.

Figure 3:
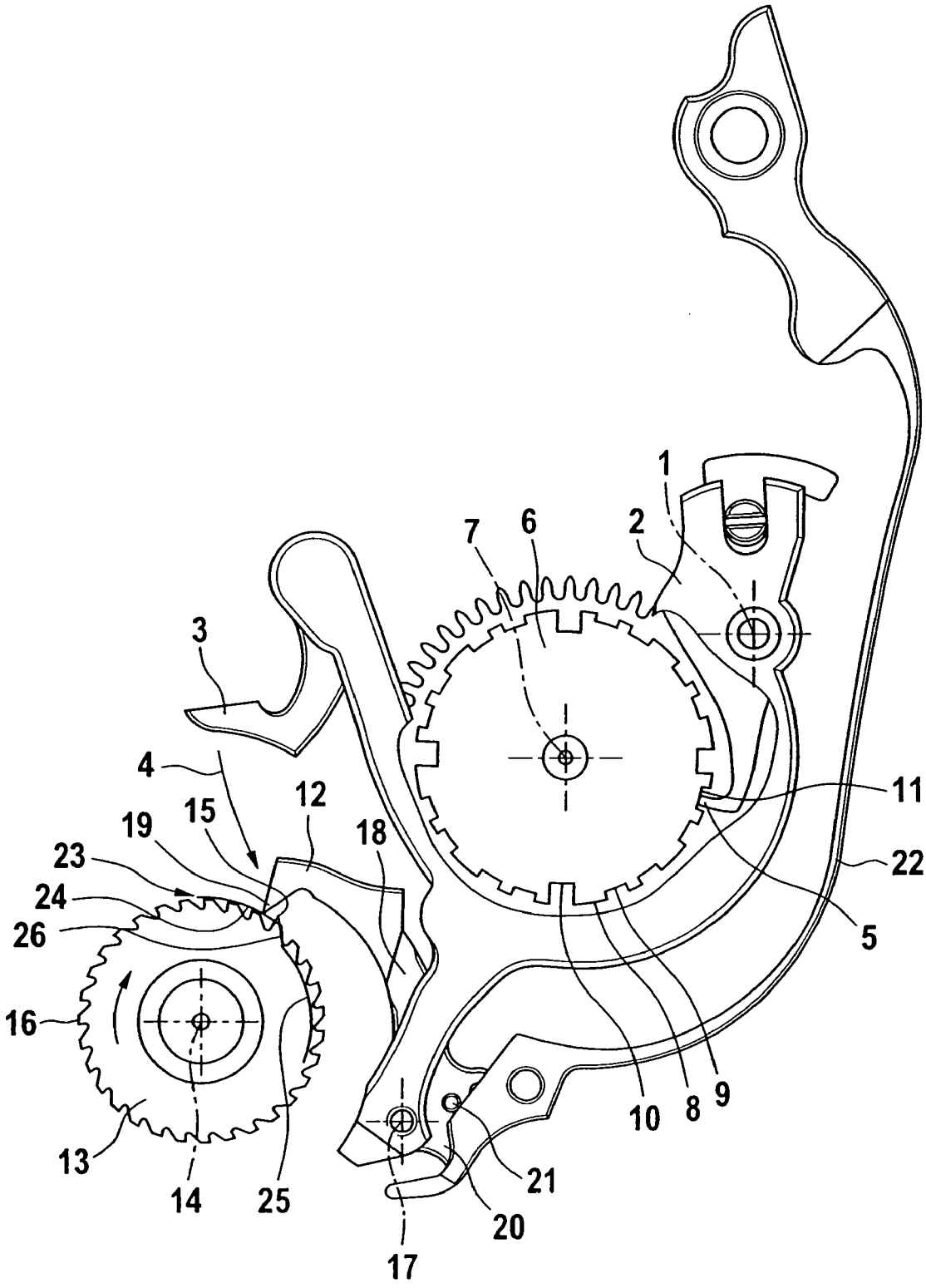
FIG. 3 is a partial cutaway view of the calendar stepping mechanism according to FIG. 1 before a stepping operation in the position corresponding to a month with 30 days.

The calendar stepping mechanism is shown in FIG. 3 in a position on the 30th day of a month with 30 days. Here the stepped month disk 6 limits the stroke of the stepping lever 2 in such a way that the calendar wheel can be advanced by two teeth.

Figure 4:
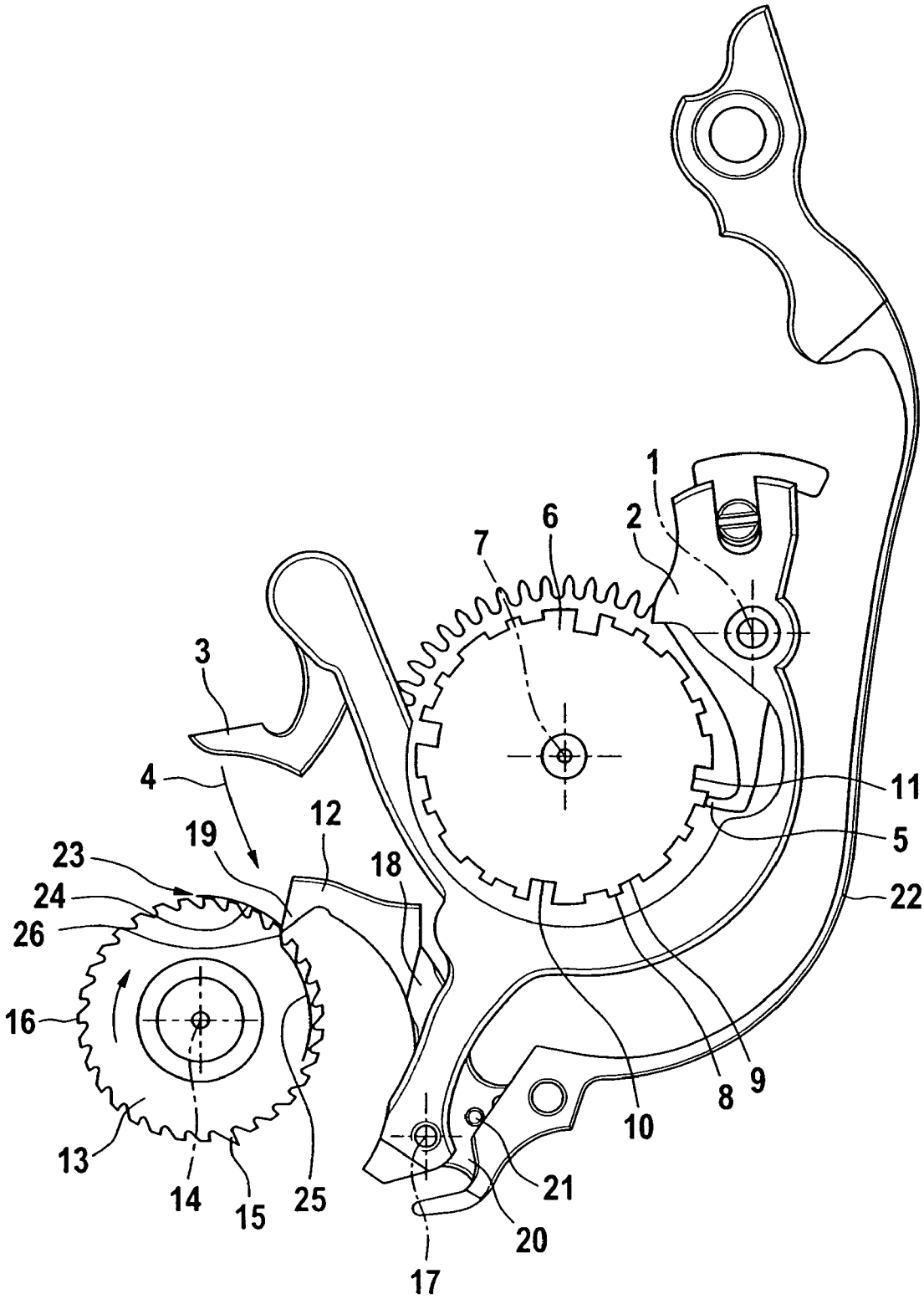
FIG. 4 is a partial cutaway view of the calendar stepping mechanism according to FIG. 1 before a stepping operation in the position corresponding to a month with thirty-one days.
Figure 5:
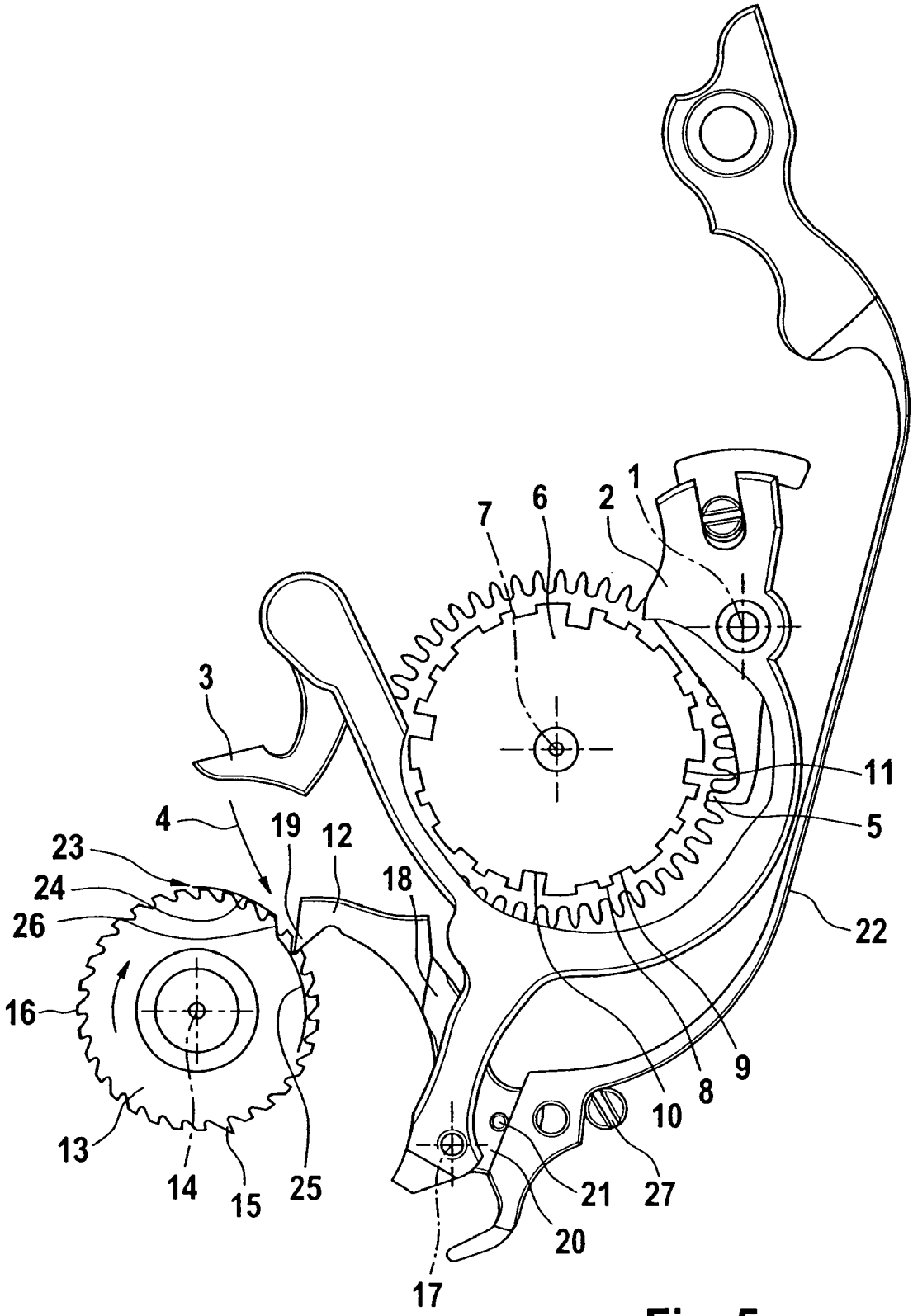
FIG. 5 is a partial cutaway view of the calendar stepping mechanism according to FIG. 1 at the end of a stepping operation.

FIG. 4 shows the starting position in months with 31 days. Here, there is no need at the end of the month to step forward an additional day to reach the first day of the new month. For this reason, the stepped month disk 6 allows the stepping lever 2 the freedom to move the distance of only one tooth. The first part 24 of the stop cam 23 and the stepping tooth 15 have no special function for months with 31 days.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A calendar stepping mechanism of an eternal calendar of a clock having a calendar date display, comprising:

a stepped month disk having a periphery provided with twenty indentations of different depths and twenty elevations, said indentations and elevations representing the forty-eight months of a leap year period, said stepped month disk being drivable to rotate at a rate of one step per month and one revolution per four years;

a stepping lever drivable once per twenty-four hours about a pivot axis between a normal position and a raised position;

a probe finger arranged on the stepping lever which is in a position against the circumferential periphery of a stepped month disk in the normal position of the stepping lever and moves radially outward in response to the pivoting movement of said stepping lever toward the raised position;

a rotatably supported calendar wheel having thirty-one teeth or a multiple thereof, wherein one of said teeth comprises a stepping tooth projecting radially beyond the other normal teeth and wherein the calendar date display is drivable by said calendar wheel;

a stepping pawl hinged to said stepping lever and having a pawl tooth, wherein said pawl tooth engages radially in the gaps between the teeth of the calendar wheel and rotates said calendar wheel in response to the pivoting movement of the stepping lever, the extent of the pivoting movement of the stepping lever depending on the contact position of the probe finger on the periphery of the stepped month disk; and a connecting link arranged such that, during the pivoting movement of said stepping lever from its normal position into its raised position, the stepping pawl slides along the connecting link, wherein during a first part of the pivoting movement of said stepping lever, the connecting link supports the pawl tooth at a radial distance from an axis of said calendar wheel between the tip circle of the normal teeth and the tip circle of said stepping tooth and, during the second part of the pivoting movement of the shifting lever, the connecting link supports the pawl tooth at a radial distance inward of the tip circle of the normal teeth, wherein a transition from the first part to the second part of the pivoting movement of the stepping lever occurs at the point which the pawl tooth occupies when the stepping lever is in its normal position and the probe finger is in contact with one of the elevations of the stepped month disk.

2. The calendar stepping mechanism of claim 1, wherein the connecting link comprises a stationary stop cam disposed along an outer circumferential periphery of the calendar wheel, the stationary stop cam having a first part and a second part, the first part of the stationary stop cam being concentric to the axis of rotation of the calendar wheel and projecting radially beyond the tip circle of the normal teeth and radially inside the tip circle of the stepping tooth, the second part also being concentric to the axis of rotation of the calendar wheel radially inside the tip circle of the normal teeth of the calendar wheel, wherein a transition between the first part and the second part of the stationary stop cam is disposed at the circumferential point which the pawl tooth occupies when the stepping lever is in the normal position and the probe finger is resting against one of the elevations of the stepped month wheel.

3. The calendar stepping mechanism of claim 1, wherein the stepping pawl is spring-loaded toward the gaps between the teeth of the calendar wheel.

4. The calendar stepping mechanism of claim 3, wherein the stepping lever is spring-loaded toward the normal position.

5. The calendar stepping mechanism of claim 4, further comprising a common spring pretensioned so that an urgency of said common spring urges the stepping lever toward the normal position and urges the stepping pawl toward the gaps of the calendar wheel.

6. The calendar stepping mechanism of claim 5, wherein the stepping pawl is a two-arm lever pivotably connected to the stepping lever so that the stepping pawl pivots around an axis parallel to the axis of rotation of the calendar wheel, wherein the pawl tooth is mounted on one of the arms of the two-arm lever and the urgency of the common spring acts on the other arm of the two-arm lever.

* * * * *